United States Patent [19]

Takimae

[11] Patent Number: 4,740,669

[45] Date of Patent: Apr. 26, 1988

[54] ELECTRIC CURLING IRON WITH INFRARED RADIATING CURLING ROD SURFACE

[76] Inventor: Toyosaku Takimae, 2-26, 2-chome, Takanawa, Minato-ku, Tokyo, Japan

[21] Appl. No.: 850,328

[22] Filed: Apr. 11, 1986

[51] Int. Cl.[4] ..... H05B 3/00; A45D 1/04; A45D 2/36; F24H 3/00

[52] U.S. Cl. ..... 219/225; 132/7; 132/9; 132/31 R; 132/32 R; 132/37 R; 132/118; 219/230; 219/346; 219/354

[58] Field of Search ..... 219/222–226, 219/354, 242, 230, 346; 132/7, 9, 11 R, 11 A, 31 R, 32 R, 33 R, 37 R, 37 A, 117, 118

[56] References Cited

U.S. PATENT DOCUMENTS

| | | | |
|---|---|---|---|
| 4,151,850 | 5/1979 | Nathe et al. | 219/225 X |
| 4,365,140 | 12/1982 | Bast et al. | 219/225 |
| 4,426,570 | 1/1984 | Hikino et al. | 219/354 |
| 4,464,562 | 8/1984 | Takimae | 219/225 |
| 4,602,143 | 7/1986 | Mack et al. | 219/225 |

FOREIGN PATENT DOCUMENTS

| | | | |
|---|---|---|---|
| 934603 | 10/1955 | Fed. Rep. of Germany | 219/354 |
| 2720961 | 11/1978 | Fed. Rep. of Germany | 219/346 |
| 2819725 | 11/1979 | Fed. Rep. of Germany | 219/222 |
| 27907 | 9/1975 | Japan | 219/354 |
| 21852 | 2/1980 | Japan | 219/354 |
| 33595 | 9/1980 | Japan | 219/354 |

*Primary Examiner*—Anthony Bartis
*Attorney, Agent, or Firm*—Armstrong, Nikaido, Marmelstein & Kubovcik

[57] ABSTRACT

Since the hair well absorbs far infrared radiation in the range of 5 to 10 μm, a material for radiating the far infrared rays having such a wavelength band, more specifically, ceramics, such as zirconia magnetite or alumina, is used on the outer surface of a rod of a curling iron. By applying a ceramic which can radiate far infrared rays to a rod of a curling iron, the temperature of the rod may be decreased to a level from 100° C. to 150° C. The ceramic layer is further coated on its outer surface with a metallic anti-corrosion layer of nickel-chrome or nickel-aluminum to withstand chemicals.

5 Claims, 2 Drawing Sheets

ELECTRIC CURLING IRON WITH INFRARED RADIATING CURLING ROD SURFACE

BACKGROUND OF THE INVENTION

1. Field of the Invention

The present invention relates to the curling irons used to correct a permanent wave or fuzzy hair, or to set hair.

2. Description of the Prior Art

In the past, for forming a permanent wave on the hair using curling irons, a moistening permanent liquid is used to wet the hair. The wet hair is rolled around the rod while the surface temperature of the rod of the curling iron is heated to a high temperature from 200° C. to 260° C. to form a permanent wave.

The above-described system has a shorter working time than that of a cold permanent using chemicals or an electric permanent using an electric device. The combination of the curling iron and moistening liquid provides a durable hair style. However, the hair is likely to be damaged using this method. That is, in this system, the hair is formed into a permanent wave while heating the surface temperature of the rod to a high level of 200° C. to 260° C., and therefore the hair becomes covered with blisters, is burned off, inflated or brittle. This problem can be solved by lowering the surface temperature of the rod to a level from 100° C. to 150° C. at which the hair is not damaged but in this range of temperatures it is not possible to form a permanent wave on the hair unless additional time is taken to set the hair. That is, hair comprises an outermost surface formed from an epidermis, while the inside is formed from a skin and the center is formed from the medulla. The portion to which a permanent wave is applied is the portion called the skin. However, an outer shell layer called the epidermis which has a poor in heat transfer is present on the surface of the skin. Therefore, when the surface temperature of the rod is lowered to 100° C. to 150° C., heat is not transmitted very well to the skin in a short period of time.

With the above-described arrangement, even if the surface temperature of the rod is lowered to 100° C. to 150° C., the far infrared rays of 5 to 10 μm radiated from the far infrared ray radiation layer are directly absorbed by the hair skin to provide for efficient heating, and the straightening of a permanent wave and fuzzy hair, hair setting and the like may be achieved efficiently in a short period of time as in the prior art. To this end, the surface of the rod encasing therein a heating member of the present invention is principally formed of a material for radiation of far infrared rays which emits the wavelength of 5 to 10 μm. This will prevent the hair from being damaged.

SUMMARY OF THE INVENTION

This invention relates to curling irons for curling the hair to form a permanent wave. Since the hair well absorbs far infrared radiation in the range of 50 to 10 μm, a material for radiating the far infrared rays having such a wavelength band, more specifically, ceramics such as zirconia is used on the surface of a rod of the curling irons. By applying a ceramic which can radiate far infrared rays to a rod of a curling iron, the temperature of the rod may be decreased to a level from 100° to 150° C. The ceramic layer is further treated with an anti-corrosion layer to withstand chemicals.

DETAILED DESCRIPTION OF THE PREFERRED EMBODIMENTS

In the following, several embodiments of the present invention will be described with reference to the accompanying drawings.

Figure 1:
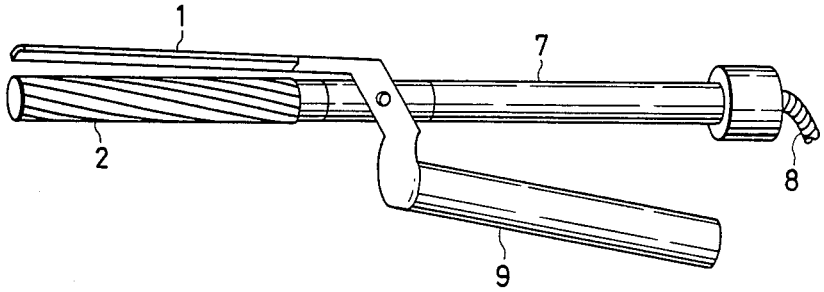
FIG. 1 is the perspective view of curling irons in accordance with the present invention.
Figure 2:
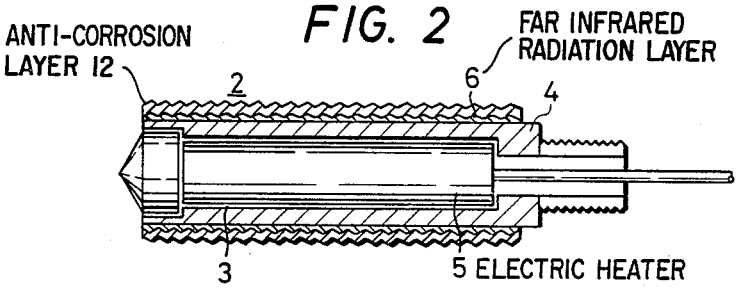
FIG. 2 is a longitudinal sectional view of the rod thereof.

In FIGS. 1 and 2, reference numeral 1 designates a clamp for nipping the hair. Reference numeral 2 designates a cylindrical rod provided opposedly of the clamp 1, which is formed from a good heat conductor, such as aluminum. The rod 2 comprises a rod case 4 provided with a groove 3 for providing for a flow of waves of the hair on the surface, and an electric heating member 5 is encased in the rod case 4. The rod case 4 is applied on the surface thereof with a far infrared ray radiation layer 6. This layer 6 is formed principally of ceramics which emit far radiation of a wavelength of 5 to 10 μm. For example, the ceramic can be alumina, zirconia or zirconia and magnetite. The layer 6 is further subjected to surfacing treatment by a layer 12 of 80 percent nickel - 20 percent chrome or 80 percent nickel - 20 percent aluminum or the like so as to withstand chemicals, such as permanent wave liquid, thus enhancing anti-corrosion and heat resistance of the layer 6. A fixed handle 7 receives therein a power source cord 8 for heating the member 5, and the rod 2 is secured to the end thereof. A movable handle 9 is supported on the fixed handle 7, and the clamp 1 is secured to the end thereof.

Figure 3:
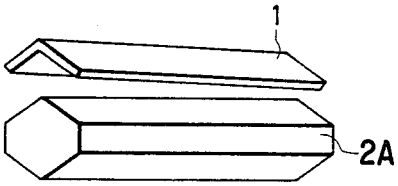
FIG. 3 is a perspective view of an embodiment of the rod.

FIG. 3 shows another embodiment of the present invention, in which the rod **2*a* is formed into a hexagonal shape, and the clamp 1** is adjusted to this shape. This rod may be of various shapes such as a square tubular shape, a semi-cylindrical shape and the like other than that as described above.

Figure 4:
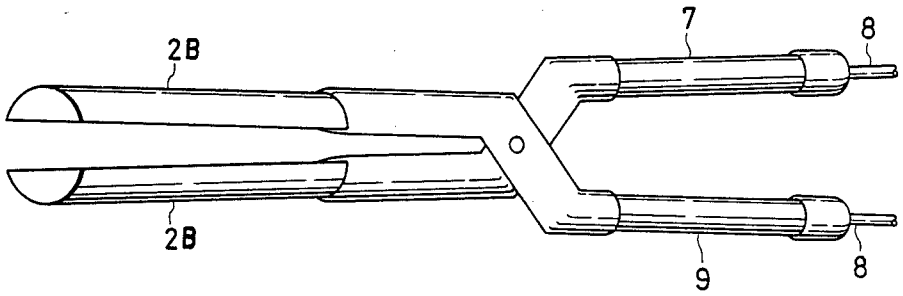
FIG. 4 is a perspective view of a further embodiment of the curling irons.
Figure 5:
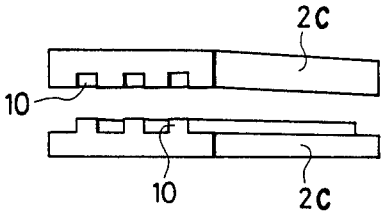
FIG. 5 is a perspective view of the rod according to another embodiment.

FIGS. 4 and 5 show still another embodiment of the present invention, in which rods **2*b*—2*b* (FIG. 4) and 2*c*—2*c* (FIG. 5) are secured to both handles 7,9 each encasing a heating member therein. In FIG. 5, tooth-forms 10 meshed with each other are formed in opposed surfaces of the rods 2*c*—2*c*. It is needless to say in these embodiments that the surfaces of the rods 2*b* or 2*c*** are applied with far infrared ray radiation layers which principally emit a wavelength of 5 to 10 μm similarly to the first-mentioned embodiment.

In the above-described structure, in use, the heating member 5 is energized, and both the handles 7, 9 are operated so that the hair is nipped between the clamp 1 and the rod 2 or between the rods **2*a*, 2*b*, or 2*c* or rolled directly about the rod 2 to effect straightening of a permanent wave or fuzzy hair, setting and the like. The hair skin to which the permanent wave is applied principally comprises a protein component, of which the main absorbing wavelength is in the range of from 5 to 10 μm, and the far infrared rays of the same wavelength band radiated from the far infrared ray radiation layer 6 of the rods 2, 2*a*, 2*b*, or 2*c* are effectively absorbed by the hair skin to heat the hair. Accordingly, it is possible to lower the surface temperature of the rods 2, 2***a*, 2*b*, or 2*c* to a level or 100° C. to 150° C. at which the hair is not damaged. With this, a permanent wave, straightening of fuzzy hair, hair setting and the like can be performed in as short a period of working time as in the prior art.

As described above, in the present invention, it is possible to lower the surface temperature of the rod to a level from 100° C. to 150° C. at which the hair is not damaged by rolling the hair around the rod for radiating the far infrared rays of 5 to 10 μm or by nipping the hair by means of the clamp or the like. Also, it is possible to perform the permanent wave, straightening of fuzzy hair, hair setting and the like efficiently in as short a period of working time as in the prior art.

It is to be noted that not only the far infrared ray radiation layer is provided on the surface of the rod but the rod case 4 itself can be formed of a far red infrared ray radiation material such as aluminum, zirconia or the like.

What is claimed is:

1. A curling iron in which the hair is rolled about or clamped, said curling iron comprising:

a handle;

a rod fixed to one end of said handle;

a heating member encased in said rod for heating said rod to a temperature suitable for forming a permanent wave, straightening out fuzzy hair and hair setting, said rod having an outer surface which is formed of a ceramic material capable of radiating far infrared rays principally having a wavelength of 5 to 10 μm, said heating member heating said rod to 100° C. to 150° C.

2. The curling iron as set forth in claim 1 wherein said outer surface of said rod is coated with a ceramic far infrared ray radiation layer principally emitting a wavelength of 5 to 10 μm to form said outer surface of said rod.

3. The curling iron as set forth in claim 2, wherein said outer surface of said ceramic far infrared ray radiation layer is provided with an anti-corrosion layer on said far infrared ray radiation layer.

4. The curling iron as set forth in claim 1, wherein said ceramic far infrared ray radiation material comprises ceramic whose main component is alumina.

5. The curling iron as set forth in claim 1, wherein said ceramic far infrared radiation material comprises ceramic whose main component is zirconia.

* * * * *